US011845296B2

(12) United States Patent
Derennaux

(10) Patent No.: US 11,845,296 B2
(45) Date of Patent: Dec. 19, 2023

(54) PAPER FASTENING RIVET AND TOOL SYSTEM

(71) Applicant: Rick Derennaux, Moore, OK (US)

(72) Inventor: Rick Derennaux, Moore, OK (US)

( * ) Notice: Subject to any disclaimer, the term of this patent is extended or adjusted under 35 U.S.C. 154(b) by 0 days.

(21) Appl. No.: 17/728,954

(22) Filed: Apr. 25, 2022

(65) Prior Publication Data

US 2023/0048865 A1 Feb. 16, 2023

Related U.S. Application Data

(63) Continuation of application No. 16/180,660, filed on Nov. 5, 2018, now Pat. No. 11,312,172.

(51) Int. Cl.

| | |
|---|---|
| ***B42B 5/08*** | (2006.01) |
| ***B21J 15/04*** | (2006.01) |
| ***B21J 15/42*** | (2006.01) |
| *A63H 33/16* | (2006.01) |

(52) U.S. Cl.

CPC ..... *B42B 5/08* (2013.01); *B21J 15/045* (2013.01); *B21J 15/42* (2013.01); *A63H 33/16* (2013.01); *B42P 2241/02* (2013.01)

(58) Field of Classification Search

CPC ..... B24B 5/08

See application file for complete search history.

(56) References Cited

U.S. PATENT DOCUMENTS 4,639,174 A * 1/1987 Denham ..... B21J 15/045 411/56

* cited by examiner

*Primary Examiner* — Jason L Vaughan
*Assistant Examiner* — Amanda Kreiling
(74) *Attorney, Agent, or Firm* — Muskin and Farmer LLC

(57) ABSTRACT

A method and system of attaching rivets to secure sheets of paper together. The rivets have a head, a recess, a skirt and a tail. A tool is configured so that the tail fits through a hole in the tool. Before the tail is inserted into the hole in the tool, the tail is inserted through two holes in the paper(s) and then in the hole in the tool. Pressure is placed on the paper by pressing downward on the tool thereby causing the paper(s) to snap into the recess, thereby securing both pieces of paper together.

5 Claims, 10 Drawing Sheets

PAPER FASTENING RIVET AND TOOL SYSTEM

BACKGROUND OF THE INVENTION

Field of the Invention

The present general inventive concept is directed to a method, apparatus, and computer readable storage medium directed to a paper fastening rivet and tool system.

Description of the Related Art

Crafts can be made by attaching pieces of paper together. Current attaching mechanisms include gluing, stapling, taping the paper together. However, such methods are not accurate and can be cumbersome.

What is needed is a more accurate and easy mechanism to fasten paper (and other materials) together.

SUMMARY OF THE INVENTION

It is an aspect of the present invention to provide an improved fastening system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
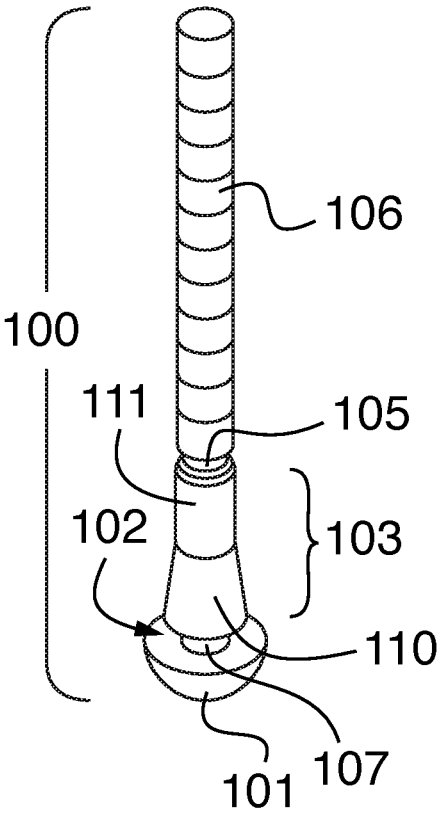
FIG. 1 is drawing of a front view of a rivet, according to an embodiment.

Reference will now be made in detail to the presently preferred embodiments of the invention, examples of which are illustrated in the accompanying drawings, wherein like reference numerals refer to like elements throughout.

The present inventive concept relates to a fastening system which is used to fasten two sheets of paper (or other similar material) together. The fastening system requires no glue, tape, staples, or other such materials and only requires rivet(s) to attach the pieces of paper. Once attached using the rivet, the two pieces of paper will be attached tightly and permanently (until the rivet is pulled out of the paper which would require a lot of force). As such, crafts using paper can be made in which the paper is attached at certain points utilizing the rivets described herein. Such crafts can include paper cars, planes, houses, rockets, etc. The rivet system described herein is also easy to utilize and children would be able to utilize the system.

The general inventive concept comprises inserting a rivet between two pieces of paper. The rivet will have a head, a skirt, and a recess between the head and the skirt in order to fit the paper therein. A special tool called a rivet tool is used to guide and push the papers into the recess. Once the papers are pressed into the recess, they cannot be removed except by tearing to remove the rivet. As such, crafts made using this system should be permanently attached together.

FIG. 1 is drawing of a front view of a rivet, according to an embodiment.

A rivet 100 has a head 101, a skirt 103, and a recess 102 between the head 101 and the skirt 103. The recess 102 is where both pieces of paper will rest when the rivet 100 is fully utilized to fasten the two pieces of paper together. The size (height) of the recess 102 is such so that it will snugly hold both pieces of paper without any wiggle room. A shaft 107 in the middle of the recess 102 connects the head 101 and the skirt 103 and is what will fit through the holes in the paper. In an embodiment, the skirt 103 comprises a tapered bottom portion 110 and a cylindrical top portion 111, although the cylindrical top portion can be optional.

A snap point 105 connects the skirt 103 to an elongated tail 106. The snap point 105 has a smaller width/diameter than the skirt 103 and the tail 106 so that it can facilitate the breaking off of the tail 106 from the skirt 103. When force is applied to the tail 106 (in a direction away from the head 101) the tail 106 would break off from the skirt 103 at the snap point 105, making a "snap" sound. The tail 106 is used to guide the rivet 100 through holes in paper but once the rivet 100 is secured in place the tail 106 is no longer needed and so the tail 106 should be broken off.

Figure 2:
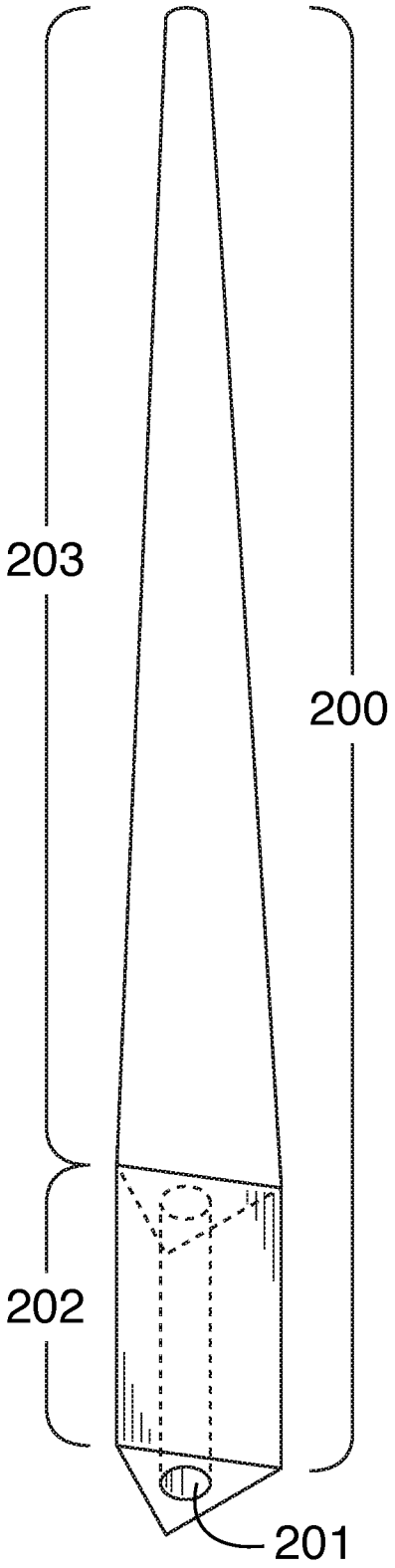
FIG. 2 is a drawing of a front view of a rivet tool, according to an embodiment.

FIG. 2 is a drawing of a front view of a rivet tool, according to an embodiment.

A tool 200 is utilized to press the paper down past the skirt 103 and into the recess 102, where the paper remains permanently. The tool has a block 202 comprising a hole 201 which is used to place over the tail 106. The tool 200 has a handle 203 which is attached to the block 202, the handle which is used by an operator to grip and use the tool 200.

Figure 3:
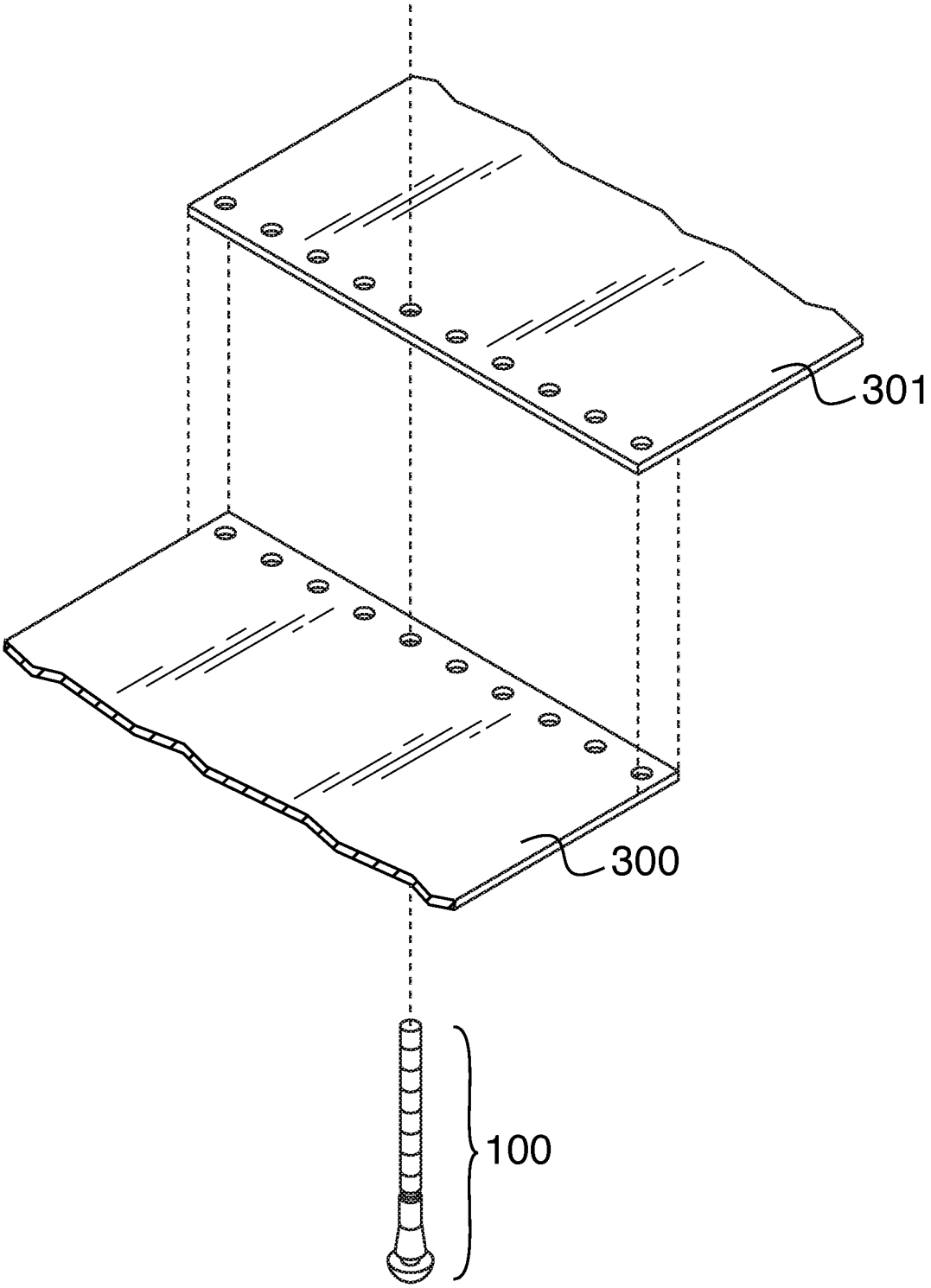
FIG. 3 is a drawing of two pieces of paper with holes and a rivet being inserted through both pieces of paper, according to an embodiment.

FIG. 3 is a drawing of two pieces of paper with holes and a rivet being inserted through both pieces of paper, according to an embodiment.

A first piece of paper 300 and a second piece of paper 301 have holes already punched in them (note that the first paper 300 and second paper 301 can also be the same sheet of paper folded over). The holes are aligned in order for the tail 106 of the rivet 100 to be placed upward (in the orientation shown in FIG. 3) through both corresponding holes. This is done without the use of the tool 200. The size (e.g., radius/diameter) of the holes (punched in the paper 300, 301) are such that the holes can be slightly smaller than an end of the tapered portion 110 (closest to the shaft 107) and the tool 200 would force the paper 300, 301 over the end of the tapered portion 110 (closest to the shaft 107) and the over the shaft 107. Once both of the paper 300, 301 are secured inside the recess 102 (around the shaft 107), there would be a snug fit therein.

As used herein, paper can refer to standard paper (of any thickness and color), or it can also refer to a malleable (bendable) plastic with a printable surface (e.g., a printable plastic sheet or film). Standard paper is a thin material produced by pressing together moist fibers of cellulose pulp derived from wood, rags or grasses, and drying them into flexible sheets.

Figure 4:
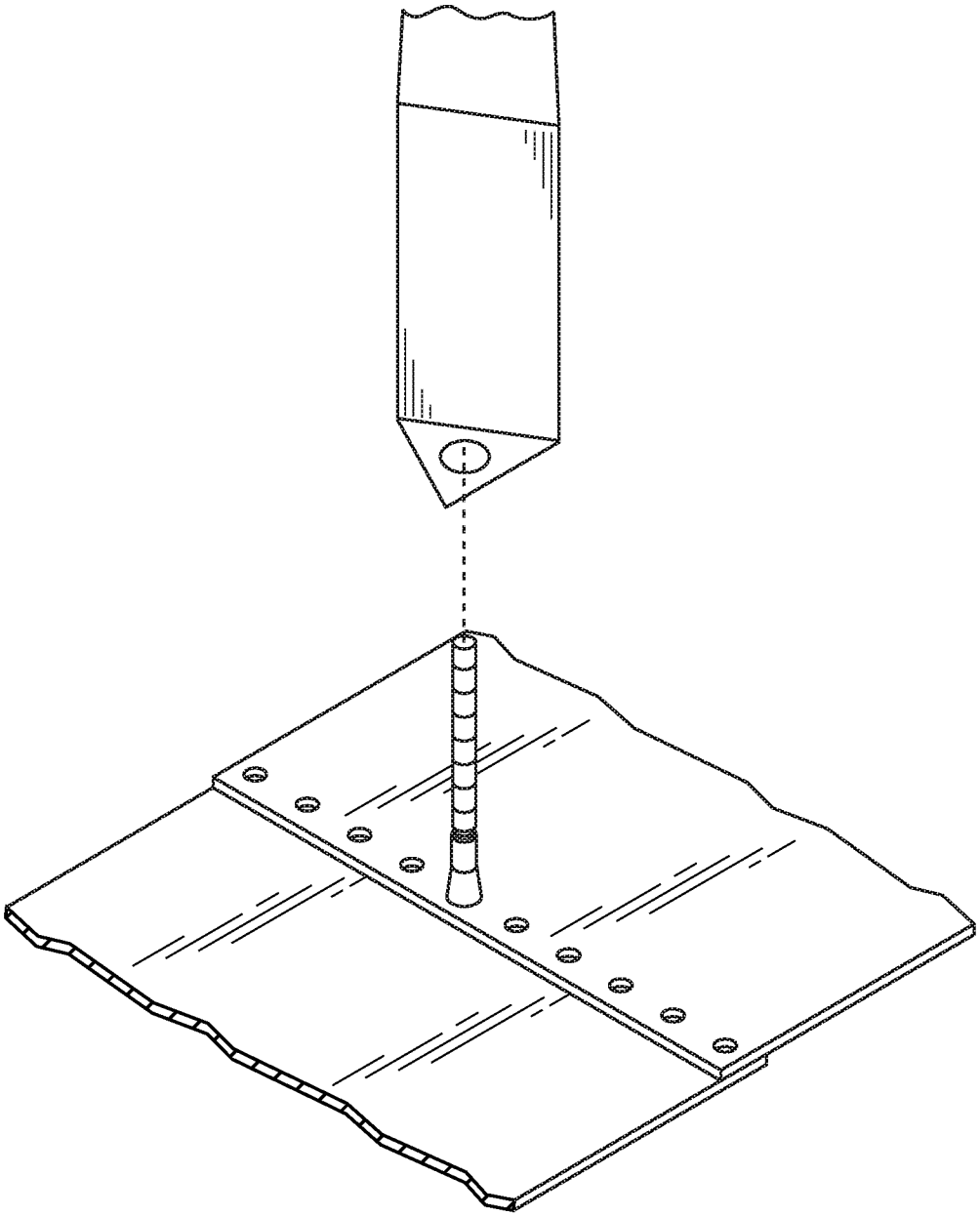
FIG. 4 is a drawing showing insertion of the rivet tool being placed over the rivet, according to an embodiment.

FIG. 4 is a drawing showing insertion of the rivet tool being placed over the rivet, according to an embodiment.

Both pieces of paper 300, 301 now rest near the bottom of the skirt 103 with the head 101 of the rivet 100 being below the paper 300, 301 and not visible in FIG. 4. Now the hole 201 in the tool 200 is placed over the tail 106 and the tool 200 is pressed down as far as the tool 200 can fit over the tail 106.

Shown in FIG. 4 are two papers 300, 301. Note that the two papers 300 and 301 can be entirely separate papers. Alternatively, the two papers 300 and 301 can be different sections of the same paper. For example, in FIG. 4, papers 300 and 301 can be entirely separate sheets of paper, or papers 300, 301 can be part of the same sheet of paper that is wrapped around in a ring (not shown). The main point is that holes in part (regardless of what paper the holes are located in) can be joined together permanently by using the system described herein.

Figure 5:
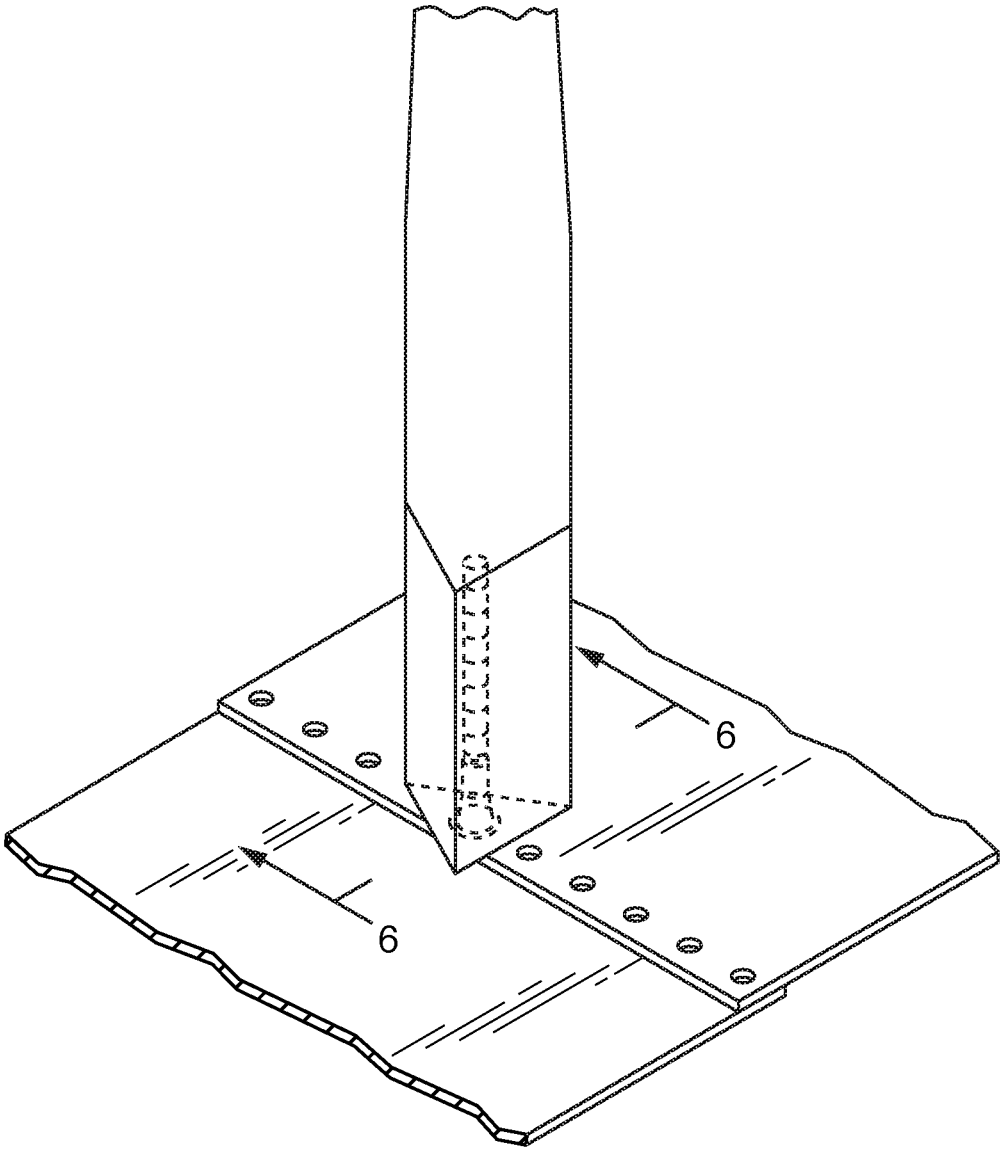
FIG. 5 is a drawing showing the rivet tool fully inserted over the rivet, according to an embodiment.

FIG. 5 is a drawing showing the rivet tool fully inserted over the rivet, according to an embodiment.

The tool 200 is fully over the tail 106 and skirt 103. The paper 300, 301 is not yet pressed inside the recess 102 and rests just above the recess 102.

Figure 6:
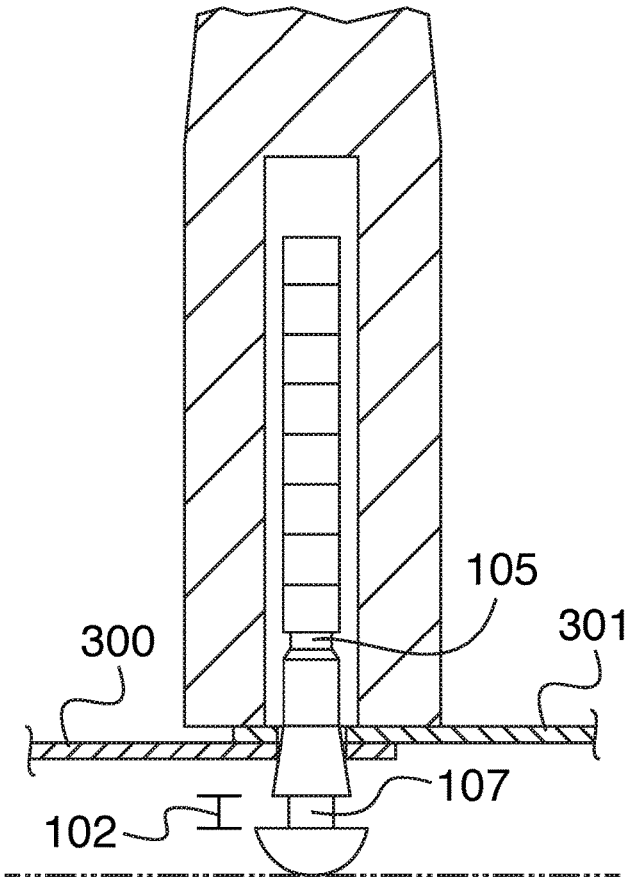
FIG. 6 is a cross section of the rivet from the view shown in FIG. 5 at a point in time before the paper is snapped into the recess, according to an embodiment.

FIG. 6 is a cross section of the rivet from the view shown in FIG. 5 at a point in time before the paper is snapped into the recess, according to an embodiment.

At this point, in order to complete the attachment process, the user will press down with a good amount of force onto the tool 200 (in the direction of the head) which will cause the paper 300, 301 to expand slightly around the bottom of the skirt 103 and fit into the recess 102. The skirt 103 may also contract slightly due to the downward force of the tool 200, allowing more room for the paper to bypass the skirt 103 and allow the paper 300, 301 to be pressed into the recess 102. At the moment the paper 300, 301 fits into the recess 102, the paper will make a "snapping" sound which signifies to the user that the paper has now been secured inside the recess 102.

Figure 7:
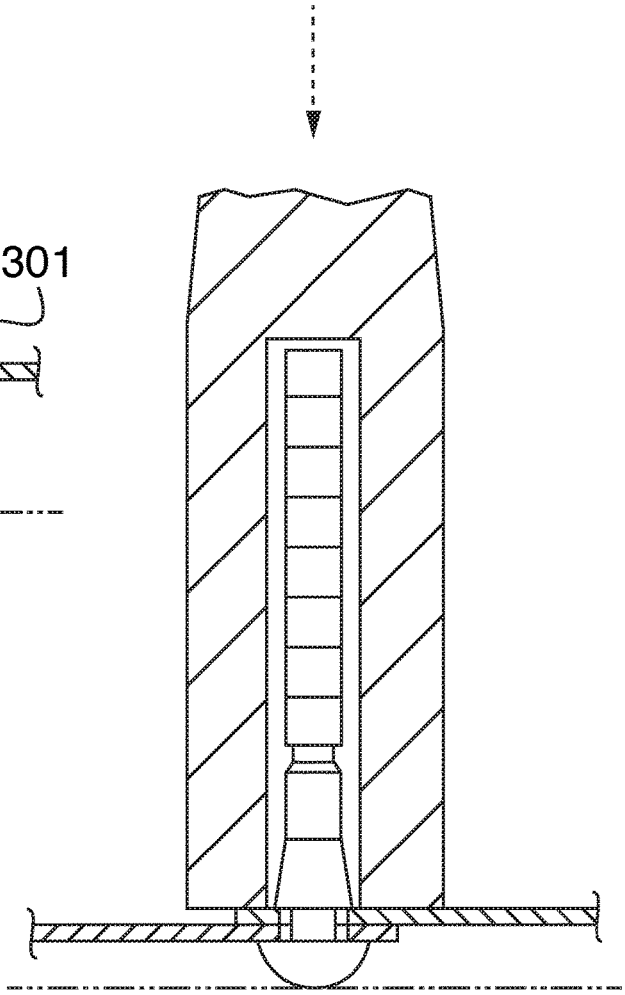
FIG. 7 is a cross section of the rivet with the paper pressed into the recess, according to an embodiment.

FIG. 7 is a cross section of the rivet with the paper pressed into the recess, according to an embodiment.

FIG. 7 follows from FIG. 6 and is the state immediately after the paper 300, 301 is placed inside the recess (due to the downward force of the tool 200) and tightly around the shaft 107. When this process occurs the "snapping" sound is made. Both pieces of paper 300, 301 are now snugly inside the recess and there is no wiggle room, thus the head 101 is securely affixed to the paper 300, 301 and hence both pieces of paper 300, 301 are now securely attached. The tool 200 would now typically be removed (raised over the tail 106).

Figure 8:
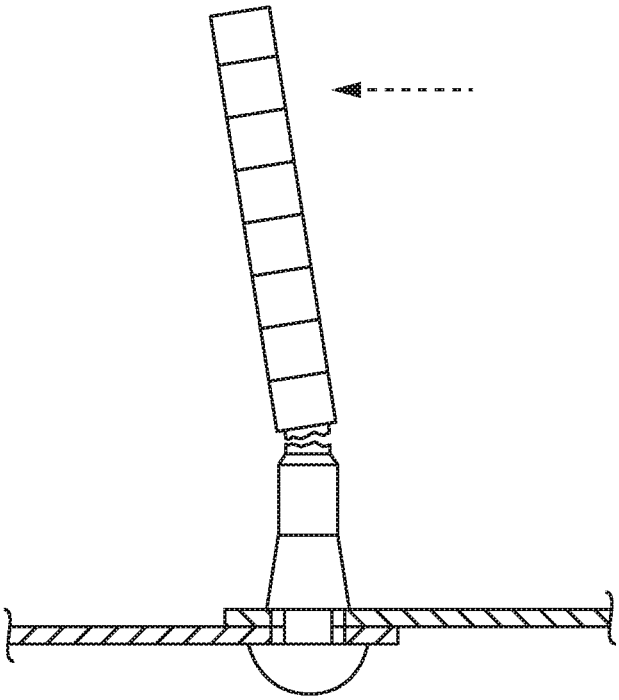
FIG. 8 is a drawing of the rivet inserted through both pieces of paper with the tail being snapped off, according to an embodiment.

FIG. 8 is a drawing of the rivet inserted through both pieces of paper with the tail being snapped off, according to an embodiment.

The tail 106 serves to help guide and position the hole 201 in the tool 200 over the tail 106 (and hence over the head 101). Once both pieces of paper 300, 301 have been secured inside the recess (with the help of the tool 200), the tail 106 no longer serves a purpose and can be removed.

The snap point 105 is structurally weaker (relative to the tail 106 and skirt 103) and would be the point where a break in the rivet would occur when force as applied to the tail 106 in a direction away from the head 101. The thickness (e.g., diameter) of the material at the snap point 105 is smaller than the tail 106 and the skirt 103 hence causing the rivet to break at the snap point 105 when such force is applied. The arrow in FIG. 8 shows a direction where force is applied and it can be seen that the tail 106 bends and breaks at the snap point 105. The arrow shows force in a lateral direction, which is away from the head 101.

Figure 9:
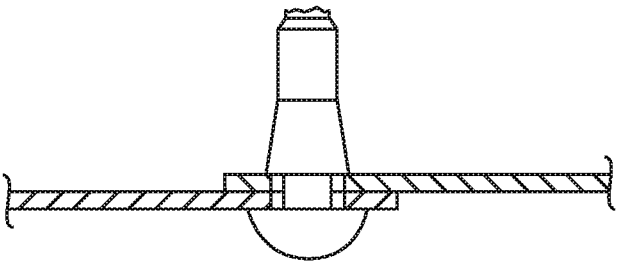
FIG. 9 is a drawing of the rivet inserted through both pieces of paper with the tail fully broken off, according to an embodiment.

FIG. 9 is a drawing of the rivet inserted through both pieces of paper with the tail fully broken off, according to an embodiment.

The tail 106 is fully broken off. This paper 300, 301 sits securely and firmly in the recess 102 between the head 101 and the skirt 103. The fastening process for this particular rivet is now complete and the papers 300, 301 are securely and permanently joined. It is recommended that multiple rivets be used to join pieces of paper in order to reduce movement of the paper and provide a more stable structure. Typically, a complex structure made out of paper (such as a paper car, etc.) would contain pre-cut holes in which a user would align the holes and secure the rivets (using the process described/shown herein) in various places to make a stable three dimensional structure. By folding the papers, aligning the holes, and joining the holes utilizing the rivet system described herein, complex three dimensional structures can be made out of a paper. A single sheet can be used and joined together as separate sheets (if cut so that portions can be folded over), or two or more separate sheets can also be used. Kits can be sold which contain a large amount of rivets 100 (e.g., 20 to 100 or more), the tool 200, and paper(s) with corresponding holes pre-cut so that rivets can be inserted through the corresponding holes which are then secured together. The paper(s) would also typically have pre-printed patterns or designs printed on them to coincide with the item being constructed (e.g., a car kit would have images resembling a car printed on the paper(s) so that when fully assembled the user has created a three-dimensional paper car).

The rivets 100 and rivet tool 200 described herein can have any suitable dimensions, such as those shown in FIGS.

10-14. Note that other dimensions can be used as well and this is merely one possible example of dimensions that can be used.

The entire rivet (and tool) can be made from any suitable material, including plastic (e.g., hard plastic, soft plastic, etc.), wood, etc. Both the rivet and the tool can also be printed (each as a single integral piece) using a 3-D printer (using standard 3-D printing materials such as ABS filament, etc.) or created using injection molding. The material can be hard (such as hard plastic), but the material used should not be that hard because the rivet should still be able to break at the snap point when pressure is applied. The rivet can (optionally depending on the materials used) contract a little while the tool is being pressed down onto the rivet.

Note that the material used to make the rivet can be of any color, e.g., black, white, etc., and the head color can match the color of the paper that the rivet is being inserted into so that rivet will be hard to see (the head color can match the paper color that the head is embedded into).

Figure 10:
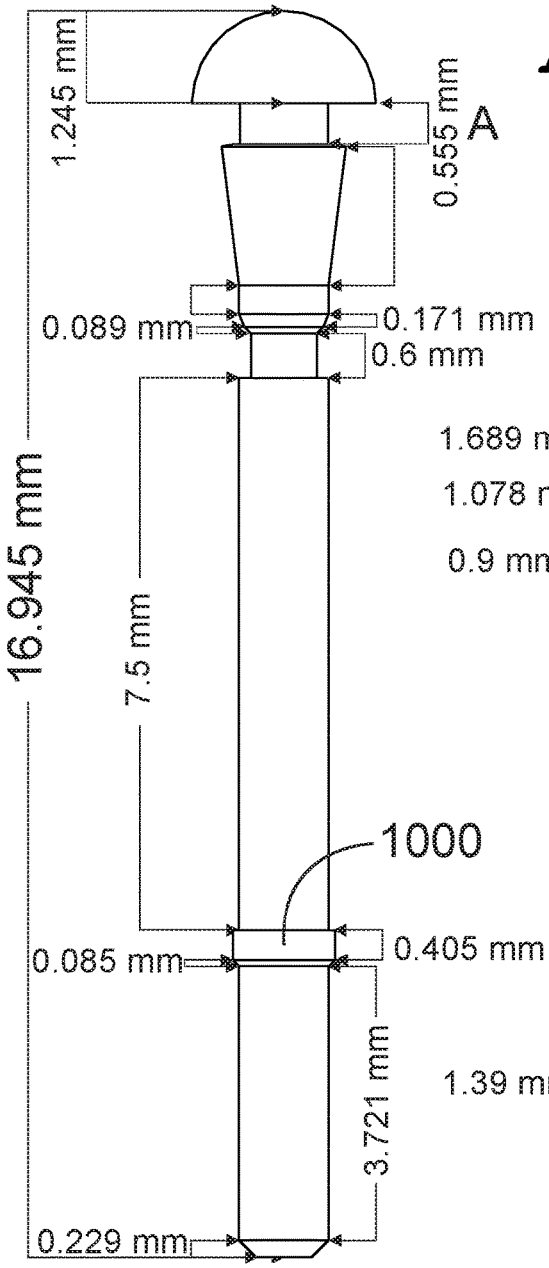
FIG. 10 is a drawing showing possible dimensions, according to an embodiment.
Figure 11:
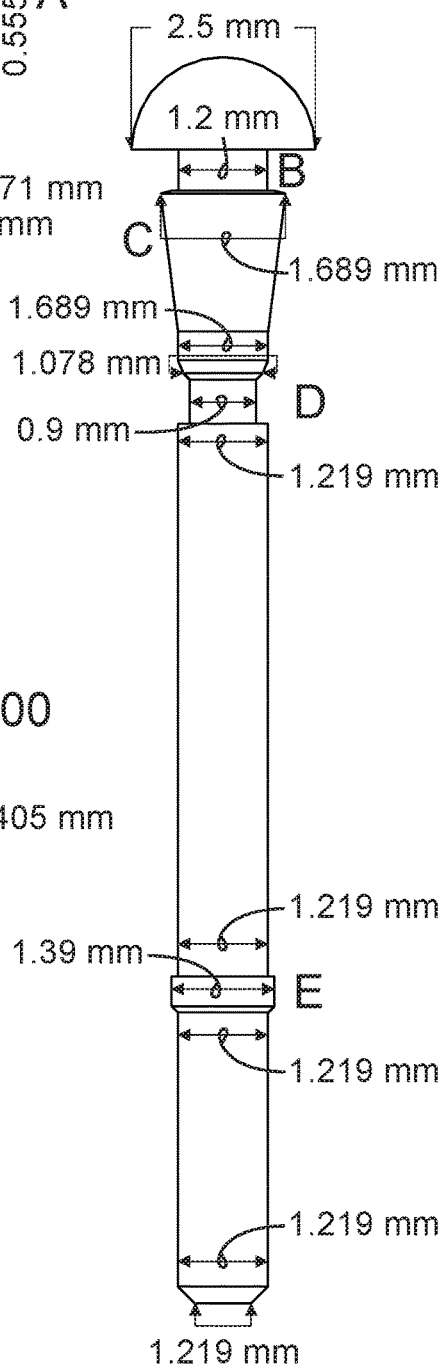
FIG. 11 is a drawing showing additional possible dimensions, according to an embodiment.
Figure 12:
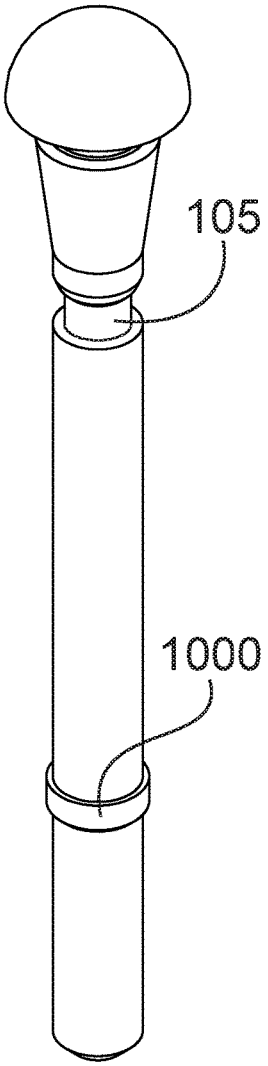
FIG. 12 is a drawing a showing a hold ring, according to an embodiment.
Figure 13:
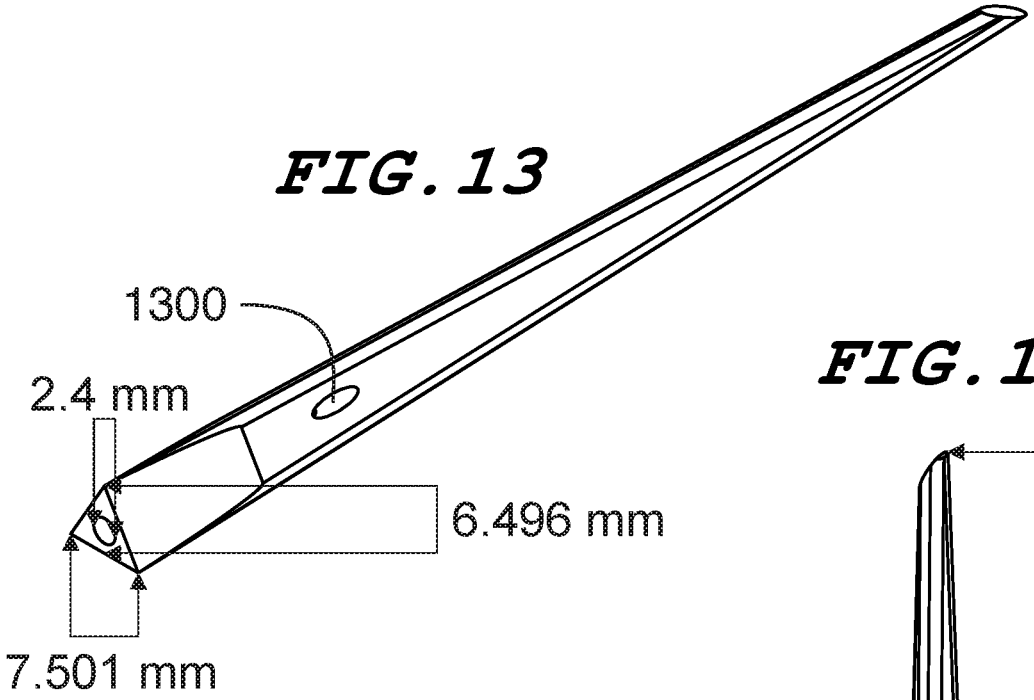
FIG. 13 is a drawing showing additional possible dimensions of the rivet tool and a channel, according to an embodiment.
Figure 14:
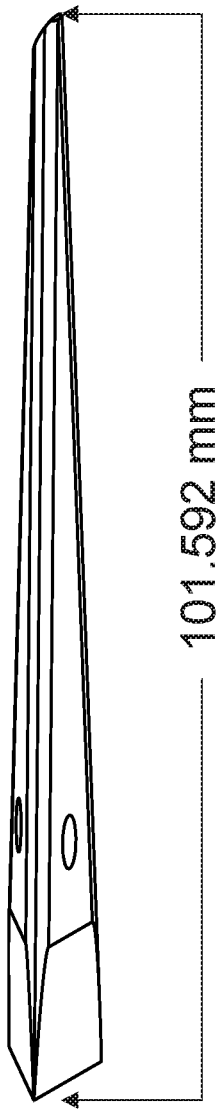
FIG. 14 is a drawing showing further possible dimensions of the rivet tool, according to an embodiment.
Figure 15:
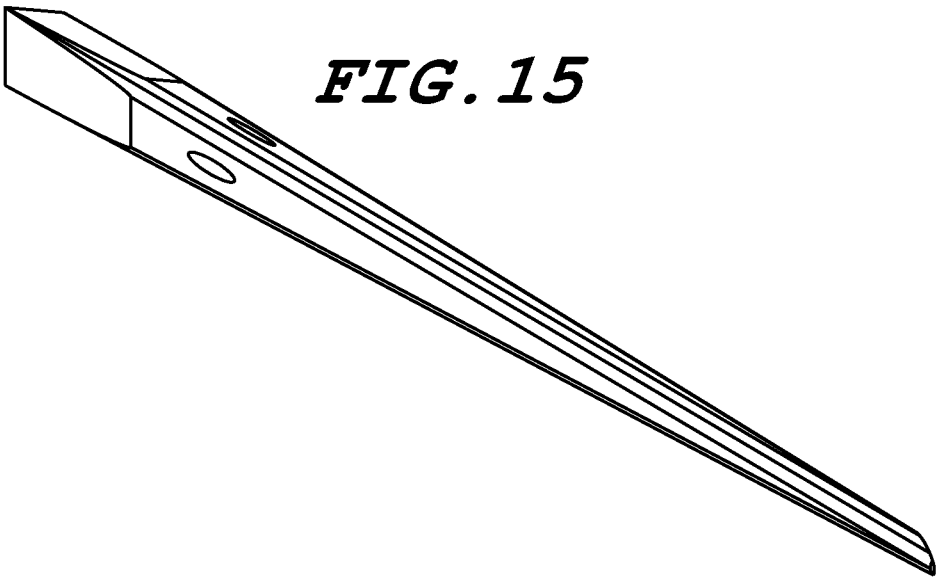
FIG. 15 is a drawing showing a further view of the rivet tool, according to an embodiment.

FIG. 10 is a drawing showing possible dimensions, according to an embodiment. FIG. 11 is a drawing showing additional possible dimensions, according to an embodiment. FIG. 12 is a drawing a showing a retaining ring, according to an embodiment. FIG. 13 is a drawing showing additional possible dimensions and a channel, according to an embodiment. FIG. 14 is a drawing showing further possible dimensions, according to an embodiment. FIG. 15 is a drawing showing a further view of the rivet tool, according to an embodiment.

In FIG. 12, the retaining ring 1000 (also shown as letter E in FIG. 11) is slightly larger than the precut holes in the paper 300, 301 which can be forced through the precut holes but can serve to keep the rivet 100 from accidentally falling out while being inserted into the paper (placed). In FIG. 13, a channel 1300 is present which is a hole in the rivet tool 200 which runs down to the hole 201. This hole enables a pin, paper clip, or other narrow stick, to stick through the channel 1300 and push out anything that might have gotten stuck in the hole 201 by pushing such unwanted item out through the hole 201.

Figure 16:
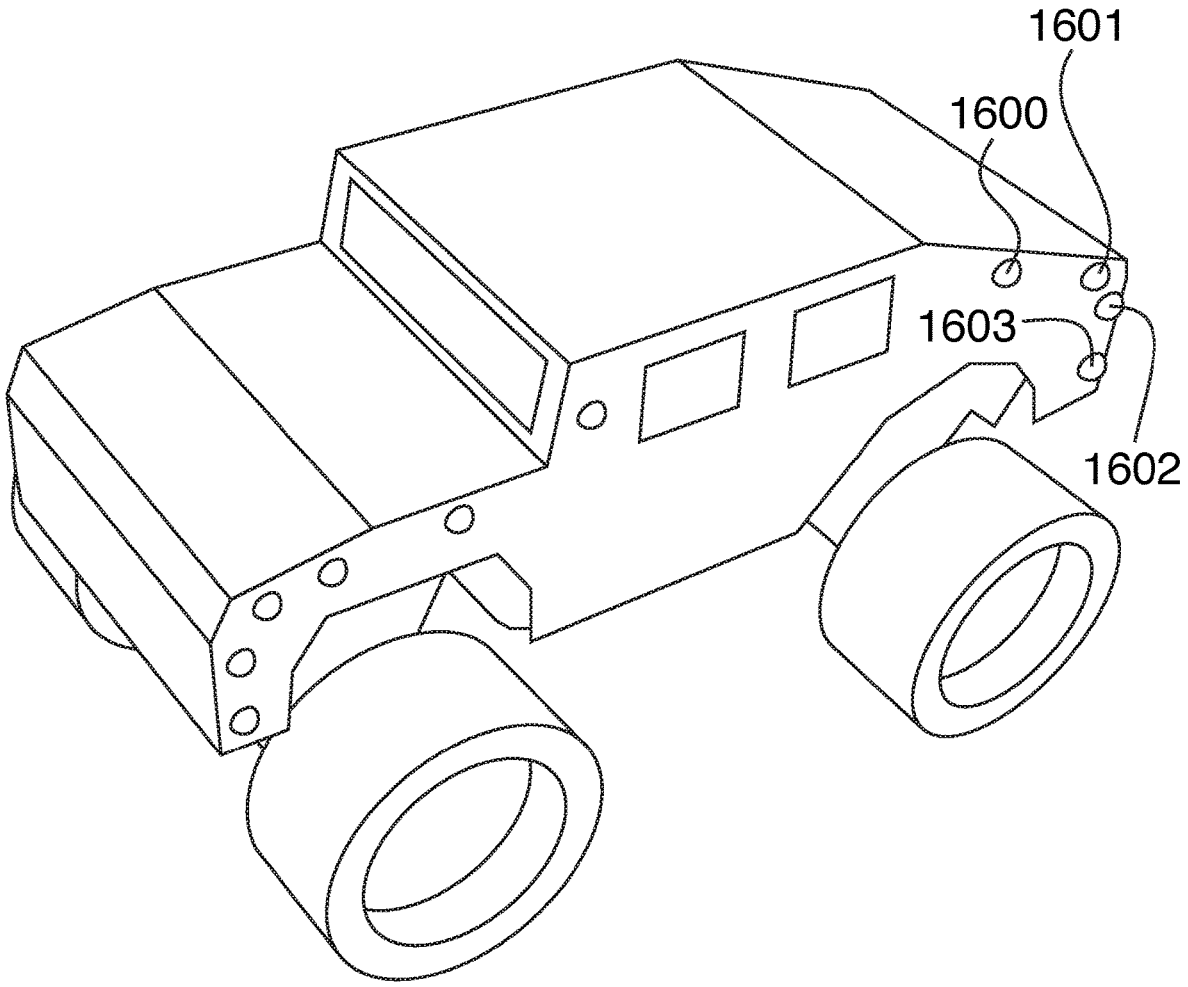
FIG. 16 is a drawing showing an assembled toy utilizing the snap rivet system described herein, according to an embodiment.

FIG. 16 is a drawing showing an assembled toy utilizing the snap rivet system described herein, according to an embodiment.

Note that rivet heads 1600, 1601, 1602, 1603 protrude through the paper. Note that any kind of toy/craft can be constructed utilizing the present invention, including cars, boats, houses, rockets, buildings, people, etc. A kit can be sold which comprises the papers (with pre-punched holes for the rivets) with pre-printed patterns on it to match the craft being made, the rivets, the rivet tool, and anything else needed to construct such toys.

Figure 17:
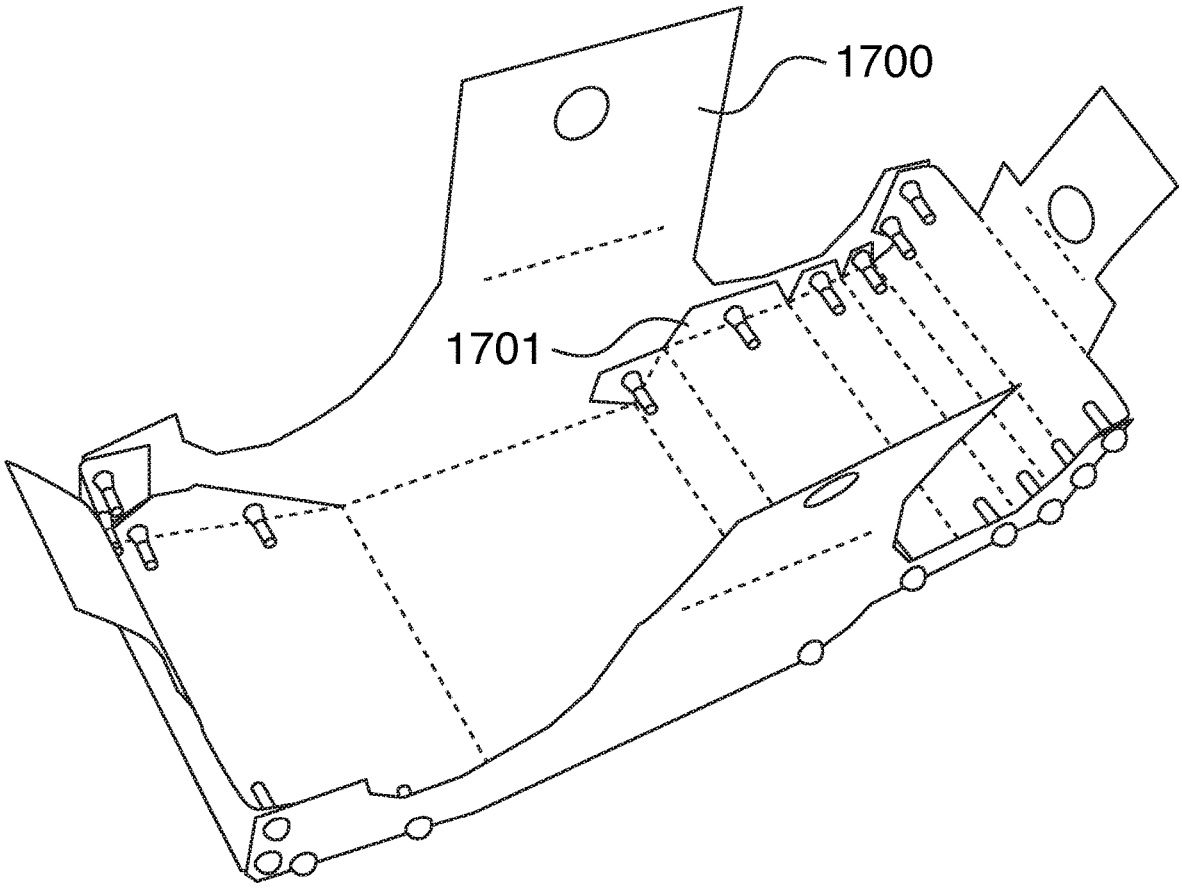
FIG. 17 is a drawing showing how two pieces of paper are connected to form the toy using the snap rivet system described herein, according to an embodiment.

FIG. 17 is a drawing showing how two pieces of paper are connected to form the toy using the snap rivet system described herein, according to an embodiment.

A first paper 1700 is attached to a second paper 1701 using the rivets, as described herein.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method, comprising:

providing a rivet comprising:

a head attached to a first end of a shaft;

a skirt attached a second end of the shaft, the second end opposite the first end, with a recess between the head and the skirt;

a tail which is elongated, the tail connected to the skirt;

a snap point between the tail and the skirt, the snap point configured to break when a lateral pressure is applied between the tail and the head;

a tool comprising a handle attached to a block, the block comprising a hole, wherein the hole is configured to receive a portion of the tail;

inserting the tail through a first hole in a first paper and a second hole in a second paper, the second paper being either a different portion of the first paper or the second paper being a different piece of paper than the first paper;

placing the handle over a portion of the tail;

pressing the handle towards the head until the first paper and the second paper are positioned inside the recess below the skirt.

2. The method as recited in claim 1, wherein the providing further provides that the skirt comprises a lower tapered portion and an upper cylindrical portion.

3. The method as recited in claim 1, wherein the pressing the handle towards the head which causes the first paper and the second paper to position inside the recess generates a snapping sound.

4. The method as recited in claim 1, wherein the providing further provides that the tail comprises a retaining ring.

5. The method as recited in claim 1, wherein the first paper and the second paper are both plastic with a printable surface.

* * * * *